US008371579B2

(12) United States Patent
Kaneko

(10) Patent No.: US 8,371,579 B2
(45) Date of Patent: Feb. 12, 2013

(54) SHEET ALIGNMENT APPARATUS AND IMAGE FORMING SYSTEM USING THE SAME

(75) Inventor: Masahiro Kaneko, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/292,248

(22) Filed: Nov. 9, 2011

(65) Prior Publication Data

US 2012/0119435 A1 May 17, 2012

(30) Foreign Application Priority Data

Nov. 15, 2010 (JP) ..... 2010-254498

(51) Int. Cl.
*B65H 9/00* (2006.01)

(52) U.S. Cl. ..... 271/239; 271/3.02; 271/221; 271/236; 271/238; 271/240

(58) Field of Classification Search ..... 271/3.01–3.03, 271/221, 222, 234, 236, 238–240
See application file for complete search history.

(56) References Cited

U.S. PATENT DOCUMENTS 8,123,215 B2 * 2/2012 Kanda ..... 271/244
2003/0034604 A1 * 2/2003 Shida et al. ..... 271/3.01

FOREIGN PATENT DOCUMENTS

JP 2007-137536 A 6/2007

* cited by examiner

*Primary Examiner* — Prasad Gokhale
(74) *Attorney, Agent, or Firm* — Holtz, Holtz, Goodman & Chick PC

(57) ABSTRACT

A sheet alignment apparatus includes: a sheet storage section for storing sheets; a sheet push-up section for conveying the sheets in the sheet discharge direction; a sheet discharge section having a pair of forward and reverse rotatable rollers configured to align sheet between the rollers and the sheet push-up section and to then discharge the sheets by sandwiching the sheet in the nip portion between the pair of rollers; and a sheet width direction alignment section located between the sheet storage section and the sheet discharge section and configured to align the sheets in the width direction perpendicular to the sheet discharge direction, wherein the sheet discharge section causes the pair of rollers in the reverse direction so as to separate the sheet edge in the sheet discharge section from the nip portion before the lateral alignment performed by the sheet width direction alignment section.

6 Claims, 15 Drawing Sheets

ENLARGED VIEW OF SECTION C

ENLARGED VIEW OF SECTION D

SHEET ALIGNMENT APPARATUS AND IMAGE FORMING SYSTEM USING THE SAME

This application is based on Japanese Patent Application No. 2010-259498 filed on Nov. 15, 2010, in Japanese Patent Office, the entire content of which is hereby incorporated by reference.

TECHNICAL FIELD

The present invention relates to a sheet alignment apparatus and image forming system, particularly to a sheet alignment apparatus capable of effective sheet finishing, and an image forming system using the same.

BACKGROUND

The image forming systems known in the conventional art include an image forming apparatus such as a printer, photocopier and multi-functional peripheral, and a post-processing apparatus that applies a process of finishing such as punching, folding and binding to the sheets with an image formed thereon by an image forming apparatus.

The post-processing apparatus as an element of the image forming system generally performs on the sheets with an image formed thereon such processes as shifting, punching, binding, folding and bookbinding by gluing. The punching section, the binding section, the folding section and the gluing/bookbinding section are provided with an alignment processing section for aligning the sheets as a pre-processing section for such processing.

This alignment processing section is generally installed inside the post-processing apparatus. This alignment processing section includes an inclined intermediate stacker and a movable regulation member on one side or both sides of the intermediate stacker, and aligns the sheets along the conveyance path for conveying sheets to the binding section or the folding section. To be more specific, sheets are slipped down in the intermediate stacker and are aligned in the sheet conveyance direction. When a preset number of sheets have been stacked on the intermediate stacker, the supply of sheets to the intermediate stacker is suspended, and the movable regulation member then reciprocally moves, so that the sheets are aligned in the width direction with respect to the sheet conveyance direction. This is followed by the finishing step including punching, binding, folding, gluing and bookbinding.

Further, some conventional post-processing apparatuses are provided with a sheet-reversing conveyance section referred to as an intermediate conveyance unit functioning as an intermediate conveyance device and is provided with a sheet width regulation member for aligning the sheet in the width direction (lateral alignment). However, a very small number of sheet-reversing conveyance sections are provided with the device that aligns the sheets in the sheet conveyance direction (longitudinal alignment). In many of the post-processing apparatuses, immediately before finishing steps such as punching, binding and folding, the leading edge or the trailing edge of the sheet is regulated in each of the finishing processes, so that the sheets are longitudinal aligned. Thus, each of the finishing processes needs time to align, and the sheet processing speed is reduced according to the conventional art. Further, in the conventional alignment processing section, conveyance of the succeeding sheet has to be stopped during the finishing operation of the preceding sheet; thus the processing speed of sheet is further reduced, and they are not compatible with the high-speed performance of the main body of the image forming apparatus, with the result that the main body of the image forming apparatus does not take full advantage of its high speed performance. Further, since the conveyance is controlled to be suspended at the time of alignment, the control system is complicated. Thus, stability in the conveyance of sheets is reduced and conveyance failure such as paper jams tends to occur.

In order to solve these problems, disclosed is a technique in which an intermediate conveyance unit is provided as an intermediate conveyance device so as to simultaneously convey a plurality of sheets, whereby the succeeding sheet is aligned even if the preceding sheet is being post-processed (e.g., Unexamined Japanese Patent Application Publication No. 2007-137536).

In the technique disclosed in the Unexamined Japanese Patent Application Publication No. 2007-137536, the intermediate conveyance unit is provided between the image forming apparatus and the post-processing apparatus. A plurality of sheets are reversed and stored there temporarily. These sheets are moved by the sheet push-up member that moves in the vertical direction, whereby a sheet is aligned with the succeeding sheet and their conveyance directions are coordinated.

FIG. 15 is a front cross sectional view of the intermediate conveyance unit B1 equipped with a sheet alignment apparatus disclosed in the Unexamined Japanese Patent Application Publication No. 2007-137536. Referring to FIG. 15, the following describes the structure and the operation of a sheet alignment apparatus as a conventional example, by using the aforementioned intermediate conveyance unit B1.

In FIG. 15, the intermediate conveyance unit B1 as an intermediate conveyance device is provided on the downstream side of the main body of the image forming apparatus in the sheet conveyance direction. A post-processing apparatus FS is installed on the downstream side of the intermediate conveyance unit B1.

The sheet conveyance section of the intermediate conveyance unit B1 includes a sheet carry-in section (the first conveyance section) 11, sheet storage section (the second conveyance section) 12, sheet discharge unit (the third conveyance section) 13, and sheet reversing section (fourth conveyance section) 14.

The sheet carry-in section 11 has a pair of rollers R1 and R2 and a sheet carry-in and conveyance path r11 provided with a guide plate 111. The sheets S ejected from the sheet ejection section 5E of the main body A of the image forming apparatus are sequentially received and conveyed by the sheet carry-in section 11. The sheet storage section 12 is provided with two guide plates 121, a lateral alignment section 122, a sheet push-up member 123 as a sheet push-up section and a sheet storage and conveyance path r12. Two guide plates 121 are arranged parallel to form a sheet storage and conveyance path r12. The sheet storage and conveyance path r12 is a conveyance path for carrying-in and discharging the sheets S to and from the sheet storage section 12. A plurality of sheets S conveyed from the sheet carry-in section 11 are aligned and stored in a state of being stacked in the sheet storage section 12. Sheets are aligned in the sheet conveyance direction between the sheet push-up member 123 and longitudinal alignment member 124, and are then aligned in the width direction by the lateral alignment section 122. After that, the sheets are discharged upward.

The sheet push-up member 123 that stands by staying at the initial stop position P0 and storing the sheets is moved upward along the guide rod 126 and the sheet storage and conveyance path r12 by a motor (not illustrated) as a sheet push-up member moving section. The sheet push-up member 123 thus moves from the initial stop position P0 to the first stop position P1 or the second stop position P2. The leading edge of the first sheet (the preceding sheet) S1 in the sheet carry-in direction is abutted to the sheet abutting plate 123A (to be described later) installed on the sheet push-up member 123. After having been stored, the first sheet S1 is moved to the first stop position P1 by the sheet push-up member 123 that is moving upward. The first stop position P1 refers to the position where the sheet push-up member stops to locate the leading edge of the preceding sheet S1 beyond the tip end of the conveyance path switching section K1 and in the area before the nip portion of the discharge drive roller R5 so as to avoid interruption of the succeeding sheet discharge drive roller R5.

After the sheet push-up member 123 for conveying the preceding sheet S1 has stopped at the first stop position P1, the succeeding sheet S2 is carried in toward the sheet storage section 12 by the rotation of the carry-in drive roller R3. When the sheet push-up member 123 is stopped at the first stop position P1, the leading edge of the preceding sheet does not interfere with the leading edge of the succeeding sheet since the leading edge of the preceding sheet is located above the leading edge of the succeeding sheet S2. After that, the motor-driven sheet push-up member 123 is sent back to the initial stop position P0 when the succeeding sheet is carried into the sheet storage section 12, and the preceding sheet and the succeeding sheet are then stored stacked. When a prescribed number of sheets S have been stored in the sheet storage section 12, the sheet push-up member 123 is again driven, by the sheet push-up member moving section, to the second stop position P2 on the downstream side of the first stop position in the sheet discharge direction and is stopped. The second stop position P2 refers to the position where the sheet push-up member 123 is stopped to cause the sheet S to be aligned in the sheet conveyance direction with the leading edge of the sheet S having reached the position where the leading edge is in contact with the longitudinal alignment member 124. Further, when the sheet push-up member 123 is at this position, the lateral alignment is also performed by the lateral alignment section 122.

A conveyance path switching section K1 is installed at the upper portion of the sheet storage section 12, and serves to switch functions between leading the sheet S into the sheet storage section 12 and discharging the sheet S from the sheet storage section 12. The sheets aligned by the longitudinal alignment member 124 are sandwiched between the discharge drive roller R5 and the driven roller R11 by the switching operation of the conveyance path switching section K1, and are conveyed to the sheet discharge unit 13.

The sheet discharge unit 13 has a sheet conveyance path r13 equipped with a pair of rollers R6 and R7 and a guide plate 131. In the sheet discharge unit 13, a plurality of sheets S stored in the sheet storage section 12 are switched back and conveyed being in the stacked state, and are fed into the succeeding post-processing apparatus FS. This switch-back operation allows the sheets to be discharged with the leading edge and trailing edge of the sheets S reversed, with respect to the direction when the sheets were carried into the sheet storage section 12, in the sheet conveyance direction.

The sheet reversing section 14 has a sheet conveyance path r14 equipped with conveyance rollers R8 and R9 and a guide plate 141. In the sheet reversing section 14, a plurality of sheets S having been stored in the sheet storage section 12 passes through the upper sheet conveyance path r15, and are switched back and reversed again along the sheet conveyance path r14. Passing through the lower sheet conveyance path r16, these sheets are discharged and fed into the succeeding post-processing apparatus FS.

The conveyance path switching section K2 arranged in the sheet discharge unit 13 ensures that the sheets S coming from the sheet storage section 12 are selectively led into the sheet conveyance path r13 for conveying these sheets to the roller pair R6 along the guide plate 13 or into the sheet conveyance path r15 for conveying them to the sheet reversing section 14. The conveyance path switching section K3 arranged on the lower portion of the sheet reversing section 14 switches path between the sheet conveyance path r15 opened by the conveyance path switching section K2 and the sheet conveyance path r16 for ejecting the sheet S from the sheet reversing section 14. The conveyance path switching sections K1, K2 and K3 are connected to solenoids to be driven.

By using the intermediate conveyance unit B1 disclosed in the Unexamined Japanese Patent Application Publication No. 2007-137536, a plurality of sheets placed stacked are longitudinally aligned at a high-speed without interference, without stopping the conveyance of the succeeding sheet even when preceding sheet is being processed.

The sheet push-up member 123 of the sheet storage section 12 for storing the preceding sheet S1 moves to the first stop position P1 before the leading edge of the succeeding sheet S2 enters the sheet storage and conveyance path r12. Accordingly, sheets can be properly placed stacked without interfering with the leading edge the preceding sheet S1.

Regarding the structure disclosed in the Unexamined Japanese Patent Application Publication No. 2007-137536, however, the longitudinal alignment member 124, the solenoid, and the link mechanism for linking the longitudinal alignment member 124 and the solenoid are indispensable in order to align a plurality of sheets stored in the sheet storage section 12 in the sheet conveyance direction. The structure using these components to align the sheets in the sheet conveyance direction increases system production cost.

In order to minimize the system production cost, there is disclosed the technique in which a nip portion is formed between the discharge drive roller R5 and the driven roller (equivalent to the discharge driven roller R11 of FIG. 15). The leading edge of the sheet S is brought into contact with the nip portion to align the sheets in the longitudinal direction (e.g., Unexamined Japanese Patent Application Publication No. 2009-274849). According to the structure of the Unexamined Japanese Patent Application Publication No. 2009-274849, the longitudinal alignment is performed by the nip portion of the discharge drive roller R5 and driven roller. This arrangement eliminates the need of installing a longitudinal alignment member 124, solenoid, and a link mechanism for linking them, with the result that the number of component are reduced, thereby cutting down the production cost.

In the structure of the Unexamined Japanese Patent Application Publication No. 2009-274849, however, the leading edge of the sheets S may be caught in the nip portion between the discharge drive roller R5 and driven roller during longitudinal alignment. Longitudinal alignment and lateral alignment by a lateral alignment section 122 cannot be easily performed simultaneously. If it is impossible to simultaneously perform the longitudinal alignment and the lateral alignment, these alignment processes must be performed separately, with the result that the sheet conveying efficiency will be reduced. Further, if the longitudinal alignment and the lateral alignment are performed at one and the same position using the time lag alone, the pressed contact between the discharge drive roller R5 and the driven roller must be released during the lateral alignment; thus this arrangement requires a complicated structure. In another method, the longitudinal alignment position is shifted from the lateral alignment position, and lateral alignment is performed at a position apart from the nip position between the discharge drive roller R5 and driven roller. There still remains the problem that she two alignment processes cannot be performed simultaneously.

SUMMARY

To achieve at least one of the abovementioned object, a sheet alignment apparatus reflecting one aspect of the present invention comprises:

a sheet storage section configured to store one or more sheets;

a sheet push-up section configured to push up a trailing edge, in a sheet conveyance direction, of a sheet stored in the sheet storage section to convey the sheet in the sheet conveyance direction;

a sheet discharge section which is provided in a downstream of the sheet storage section in the sheet conveyance direction, is made up of a pair of rollers capable of rotating in forward and reverse directions, and is configured to align the sheet being conveyed by the sheet pushing-up section between the sheet discharge section and the sheet push-up section and then discharge the sheet from the sheet storage section by a forward rotation of the pair of rollers by holding the sheet in a nip portion formed by the pair of roller;

a sheet width direction alignment section which is provided between the sheet storage section and the sheet discharge section and is configured to align the sheet in a sheet width direction, which is perpendicular to the sheet conveyance direction, after the sheet is stored in the sheet storage section and before the sheet is discharged in the sheet conveyance direction by the pair of rollers; and a control section configured to control operations of the sheet push-up section, the sheet discharge section, and the sheet width direction alignment section such that when a leading edge, in the sheet conveyance direction, of the sheet being pushed up by the sheet push-up section has reached the sheet discharge section, the sheet is aligned in the sheet conveyance direction between the sheet discharge section and the sheet push-up section, and before the sheet is aligned in the sheet width direction by the sheet width direction alignment section, the pair of roller reversely rotates so as to separate the leading edge of the sheet from the nip portion.

An image forming system reflecting another aspect of the present invention comprises:

an image forming apparatus configured to form an image on a sheet;

a sheet alignment apparatus which is provided on a downstream side, in a sheet conveyance direction, of the image forming apparatus and is configured to receive and align sheets on which images are formed by the image forming apparatus: the sheet alignment apparatus including:

a sheet storage section configured to store one or more of the sheets;

a sheet push-up section configured to push up a trailing edge, in a sheet conveyance direction, of a sheet stored in the sheet storage section to convey the sheet in the sheet conveyance direction;

a sheet discharge section which is provided in a downstream of the sheet storage section in the sheet conveyance direction, is made up of a pair of rollers capable of rotating in forward and reverse directions, and is configured to align the sheet being conveyed by the sheet pushing-up section between the sheet discharge section and the sheet push-up section and then discharge the sheet from the sheet storage section by a forward rotation of the pair of rollers by holding the sheet in a nip portion formed by the pair of roller;

a sheet width direction alignment section which is provided between the sheet storage section and the sheet discharge section and is configured to align the sheet in a sheet width direction, which is perpendicular to the sheet conveyance direction, after the sheet is stored in the sheet storage section and before the sheet is discharged in the sheet conveyance direction by the pair of rollers; and a control section configured to control operations of the sheet push-up section, the sheet discharge section, and the sheet width direction alignment section such that when a leading edge, in the sheet conveyance direction, of the sheet being pushed up by the sheet push-up section has reached the sheet discharge section, the sheet is aligned in the sheet conveyance direction between the sheet discharge section and the sheet push-up section, and before the sheet is aligned in the sheet width direction by the sheet width direction alignment section, the pair of roller reversely rotates so as to separate the leading edge of the sheet from the nip portion; and a post-processing apparatus which is provided on a downstream side of the sheet alignment apparatus and is configured to perform a post-process on the sheet discharged from the sheet alignment apparatus.

DETAILED DESCRIPTION OF THE PREFERRED EMBODIMENT

The following describes the present invention with reference to embodiments, without the present invention being restricted thereto.

[Image Forming System]

Figure 1:
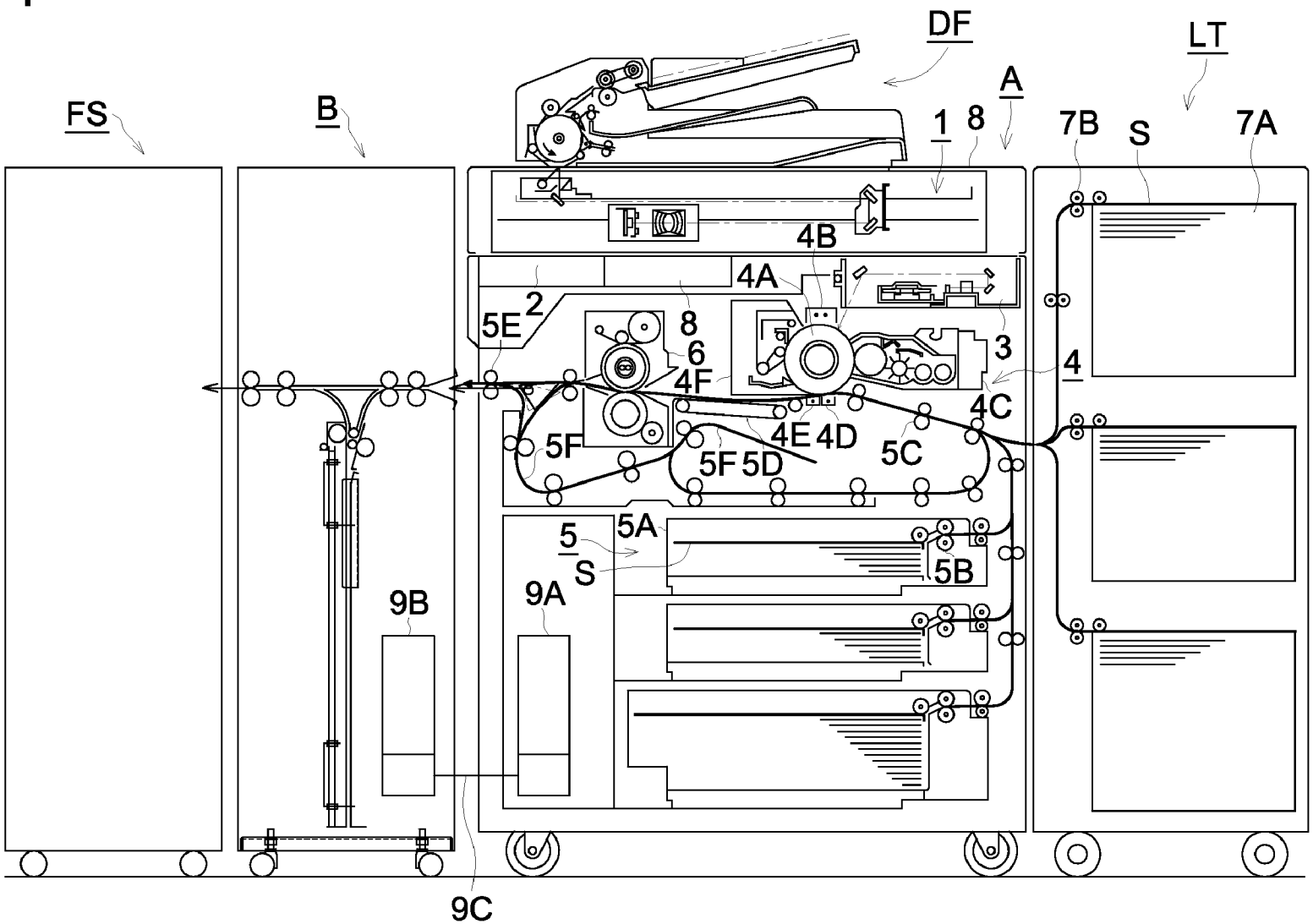
FIG. 1 is an overall schematic diagram representing an image forming system including an image forming apparatus main body A, an intermediate conveyance unit B, and a post-processing apparatus FS, according to an embodiment of the present invention.

FIG. 1 is an overall schematic diagram representing an image forming system including an image forming apparatus main body A, an intermediate conveyance unit B, and a post-processing apparatus FS according to an embodiment of the present invention. The intermediate conveyance unit B is located on the downstream side of the image forming apparatus main body A in the sheet ejection direction. The post-processing apparatus FS is located on the downstream side of the intermediate conveyance unit B in the sheet discharge direction.

[Image Forming Apparatus Main Body A]

The illustrated image forming the apparatus main body A includes an image reading section 1, an image processing section 2, an image writing section 3, an image forming section 4, a sheet feed and conveyance section 5 and fixing device 6.

The image forming section 4 is composed of a photoreceptor drum 4A, charging section 4B, development section 4C, transfer section 4D, separation section 4E and cleaning section 4F. The sheet feed and conveyance section 5 is provided with a sheet feed cassette 5A, a first sheet feed section 5B, a second sheet feed section 5C, a conveyance section 5D, a sheet ejection section 5E and an automatic duplex sheet feed unit (ADU) 5F. An operation/display section 8 equipped with an input section and a display section is provided on the front side of the upper portion of the image forming apparatus main body A. An automatic document feeder DF is mounted on the upper portion of the image forming apparatus main body A. The intermediate conveyance unit B as an sheet alignment apparatus of the present invention is installed on the side of the sheet ejection section 5E on the left side, in the drawing, of the image forming apparatus main body A, and a post-processing apparatus FS is connected on the left side of that.

Images on one side or both sides of the document placed on the document platen of the automatic document feeder DF are read through the optical system of the image reading section 1. The analog signal generated by photoelectric conversion from the images having been read is subjected to analog processing, analog-to-digital conversion, shading correction and image compression by the image processing section 2. After that, this signal is sent to the image writing section 3. In the image writing section 3, the light outputted from the semiconductor laser is applied to a photoreceptor drum 4A of the image forming section 4, whereby a latent image is formed. Processes such as charging, exposure, development, transfer, separation and cleaning are carried out in the image forming section 4.

The image is transferred by the transfer section 4D to the sheet S fed by the first sheet feed section 5B. The image carried on the sheet S is fixed by a fixing device 6, and the sheet S is fed into the intermediate conveyance unit B from the sheet ejection section 5E. Alternatively, the sheet S on one side of which an image has been processed and which has been fed to the automatic duplex copying sheet feed section 5F is image-processed on the both sides again by the image forming section 4. After that, the sheet S is ejected through the sheet ejection section 5E and is fed into the intermediate conveyance unit B.

The communication section of the main control section 9A installed inside the image forming apparatus main body A and the communication section of the control section 9B installed inside the intermediate conveyance unit B are connected by the communication line 9C, and send and receive input signals and control signals. Further, the control section 9B controls the operation of each section inside the intermediate conveyance unit B through exchange of signals with the main control section 9A.

A large capacity sheet feeding section LT includes a sheet stacking section 7A and a first sheet feed section 7B, and feeds a large number of sheets into the image forming apparatus main body A on a continuous basis. The post-processing apparatus FS receives the sheets S discharged from the intermediate conveyance unit B, and applies the finishing processes including punching, folding and binding.

[Intermediate Conveyance Unit B]

The intermediate conveyance unit B is an intermediate conveyance device for delivering the sheet from the image forming apparatus main body A to the post-processing apparatus FS so that the efficiency of the entire system will not be reduced even when there is a difference in throughput between the image forming apparatus main body A and post-processing apparatus FS.

Figure 2A:
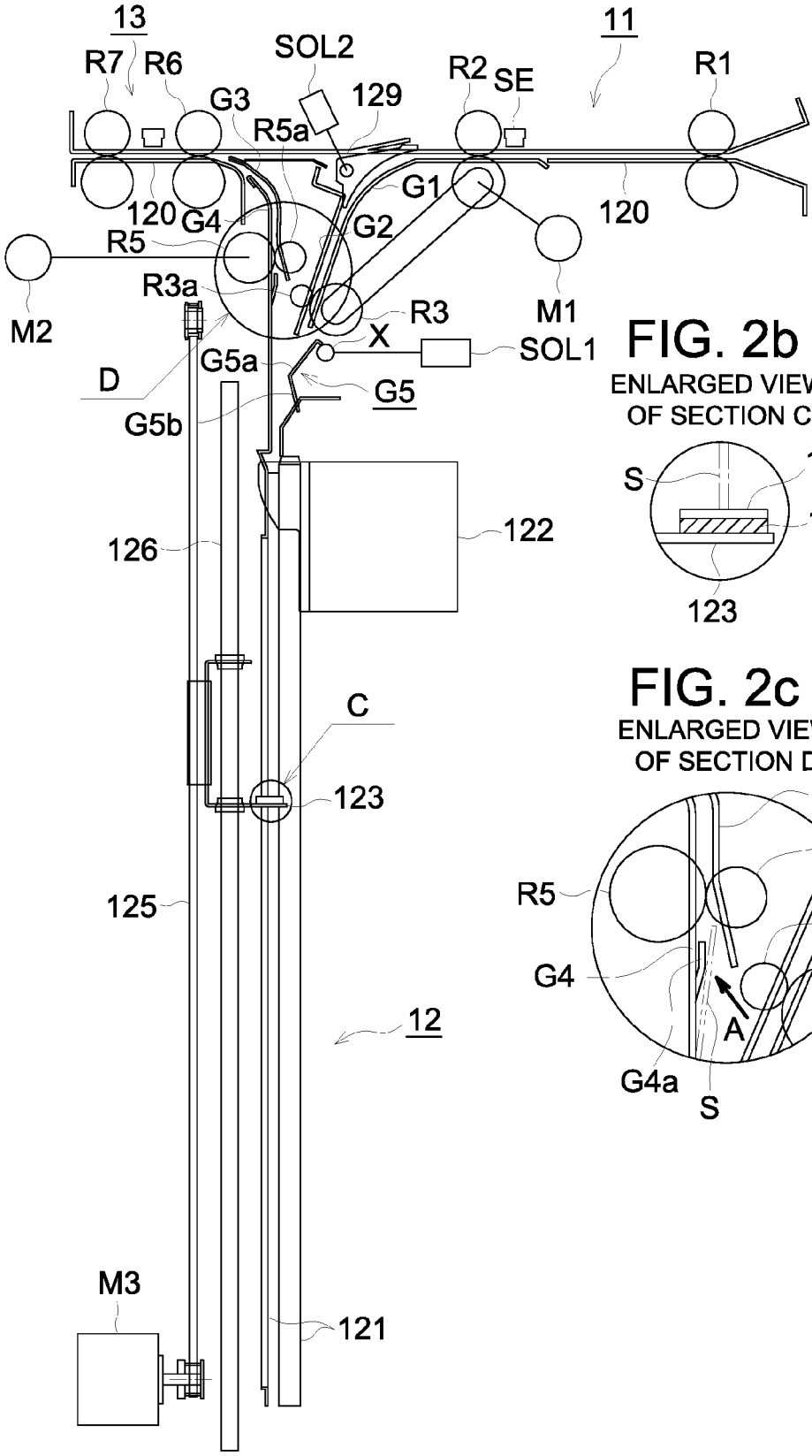
FIGS. 2*a*, 2*b* and 2*c* are front cross sectional views showing an intermediate conveyance unit B according to an embodiment of the present invention as viewed from the direction perpendicular to sheet discharge direction.
Figure 2B:
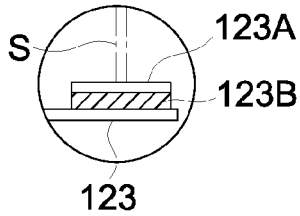
Figure 2C:
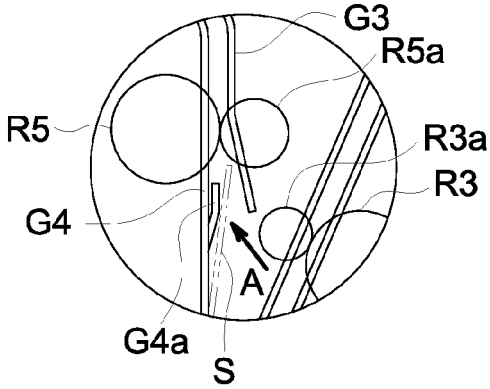
Figure 3:
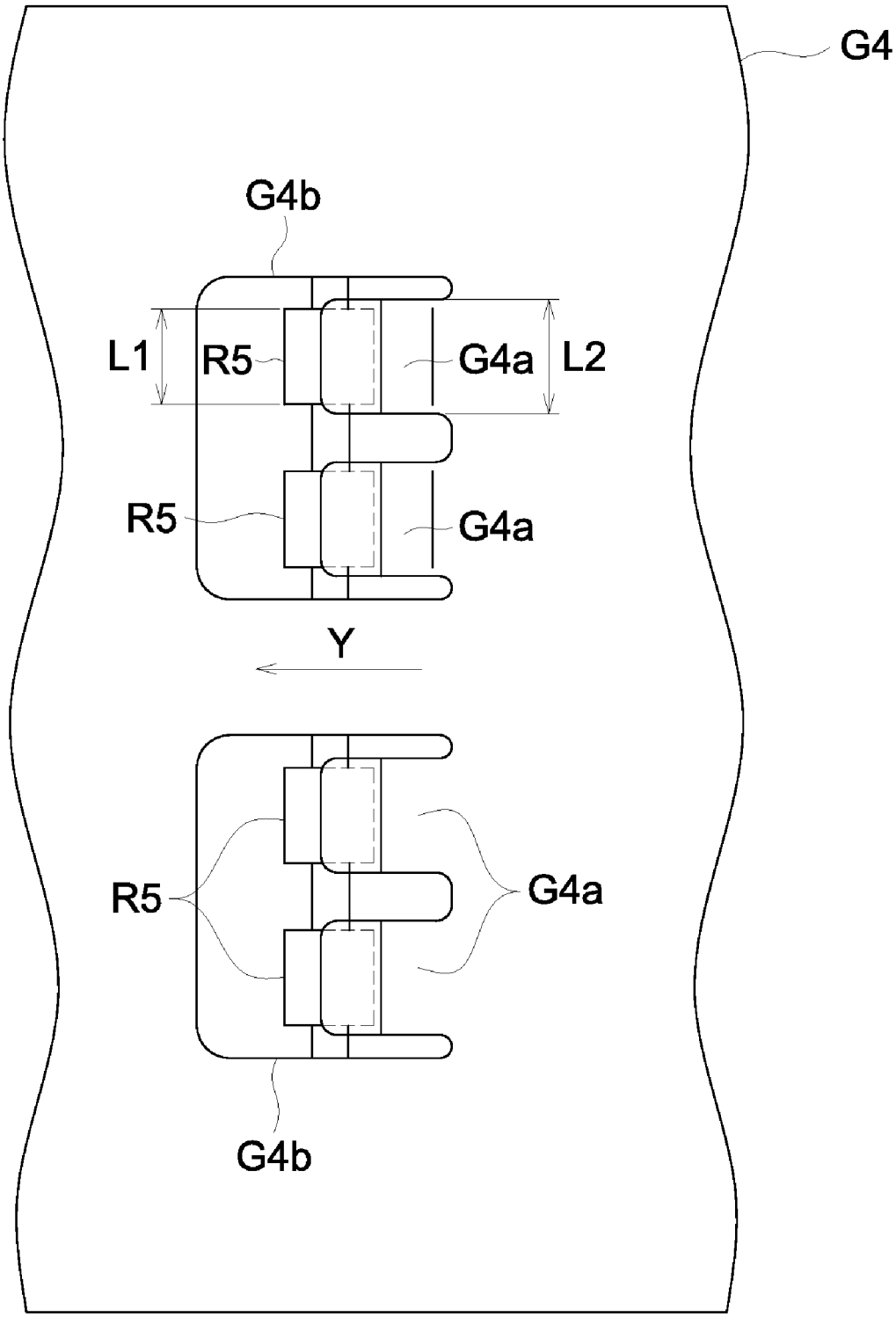
FIG. 3 is a view in the direction of the arrow A in FIG. 2*c;*
Figure 4:
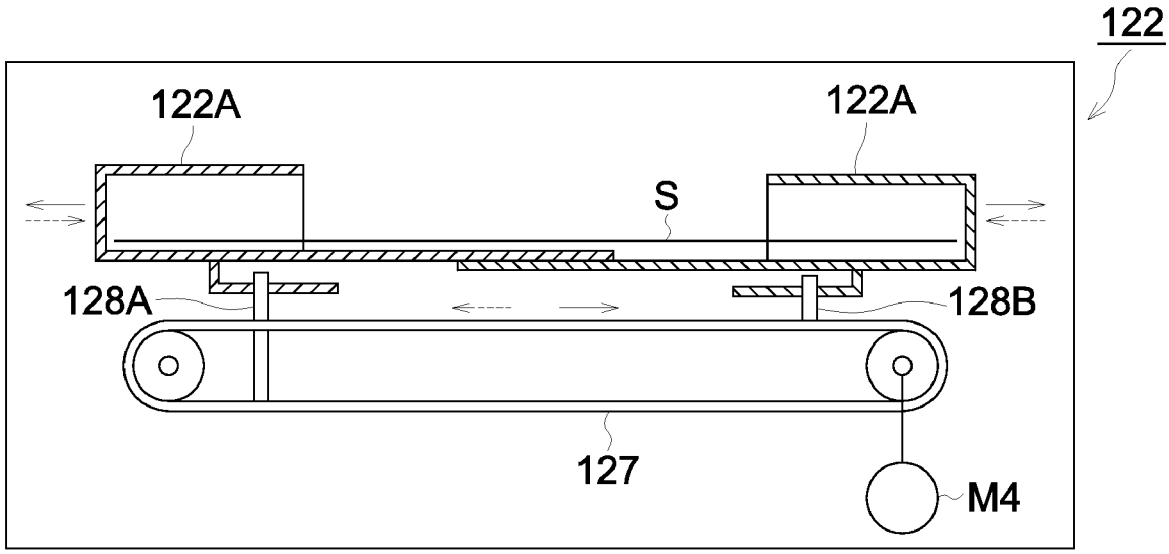
FIG. 4 is a schematic diagram representing the lateral alignment section 122 of FIGS. 2*a*, 2*b* and 2*c* as viewed from the side.

FIG. 2*a* through FIG. 4 are schematic views showing the structure and the operation of an intermediate conveyance unit B of the embodiment of the sheet alignment apparatus according to the present invention; projections G4*a* formed on guide members G4 of the embodiment; and a lateral alignment section 122 as a sheet width direction alignment section. FIGS. 2*a*, 2*b* and 2*c* are front cross sectional views showing an intermediate conveyance unit B as viewed from the direction perpendicular to the sheet discharge direction. FIG. 3 is a view in the direction of the arrow A in FIG. 2*c*. FIG. 4 is a schematic diagram representing the lateral alignment section 122 of FIGS. 2*a*, 2*b* and 2*c* as viewed from the side.

[Structure of Intermediate Conveyance Unit B]

In FIGS. 2*a*, 2*b* and 2*c*, the FIG. 2*a* is a front cross sectional view of the intermediate conveyance unit B; FIG. 2*b* is an enlarged view of the section C as part of the sheet push-up member 123 in FIG. 2*a*; and FIG. 2*c* is an enlarged view of the section D in the vicinity of the discharge drive roller R5 of FIG. 2*a*. As shown in FIG. 2*a*, the intermediate conveyance unit B is equipped with a sheet carry-in section 11, a sheet storage section 12, and a sheet discharge unit 13.

The sheet carry-in section 11 receives one or more sheets S (hereinafter also referred to merely as "sheets S") ejected from the image forming apparatus main body A, and carry the sheets S into the sheet storage section 12. The sheet storage section 12 receives one or more sheets S from the sheet carry-in section 11 and stores the sheets. The sheet storage section 12 is structured so as to reverse the sheet conveyance direction (sides) and to feed one or more received sheets S to the sheet discharge unit 13. The sheet discharge unit 13 discharges the sheets from the sheet storage section 12.

The intermediate conveyance unit B has two conveyance modes. In one mode, the sheets S are fed from the sheet carry-in section 11, aligned through the sheet storage section 12, and unloaded from the sheet discharge unit 13. In the other mode, the sheets S are conveyed directly to the sheet discharge unit 13 from the sheet carry-in section 11, and discharged from the sheet discharge unit 13.

The sheet carry-in section 11 has a pair of rollers R1 and R2, a carry-in drive roller R3, a driven roller R3*a*, a pair of guide members 120, and guide members GI and G2. A pair of guide members 120 are the fixed guide members for guiding the sheets in the horizontal direction. The guide members G1 and G2 are the fixed guide members for guiding downward the sheets from the horizontal direction to the vertical direction. The swing guide plate G5 has two sheet guide sections G5*a* and G5*b*, and is arranged in the vicinity of the confluence of the sheet conveyance paths of the sheet carry-in section 11 and sheet storage section 12. Further, the swing guide plate G5 is driven by the solenoid SOL1 (FIG. 2*a* and FIG. 14) as a guide plate driving section, and oscillates and rotates about the X-axis. A pair of rollers R1 and R2 are driven and rotated by the motor M1 (FIG. 2*a* and FIG. 14), and the carry-in drive roller R3 is coupled to the roller pair R2 by a belt or the like, and is rotated. The carry-in drive roller R3 and driven roller R3*a* are installed on the downstream side of the sheet storage section 12 in the sheet discharge direction, and the swing guide plate G5 is installed on the downstream side of the carry-in drive roller R3. Here the terms "downstream" and "upstream" are used with respect to the conveyance direction of the sheets S.

The sheet storage section 12 includes a pair of sheet retainer plates 121 parallel to each other as guide plates for guiding the sheets S in the vertical direction, a lateral alignment section 122 for aligning the sheets S in the width direction (the direction perpendicular to the sheet conveyance direction), and a sheet push-up member 123 for storing and conveying the sheets S. The leading edge of the sheets S in the sheet carry-in direction loaded from the sheet carry-in section 11 is stopped on the sheet abutting plate 123A (to be described later) installed on the sheet push-up member 123, and the sheets S are held in the upright position in the vertical direction by the sheet retainer plates 121.

Figure 14:
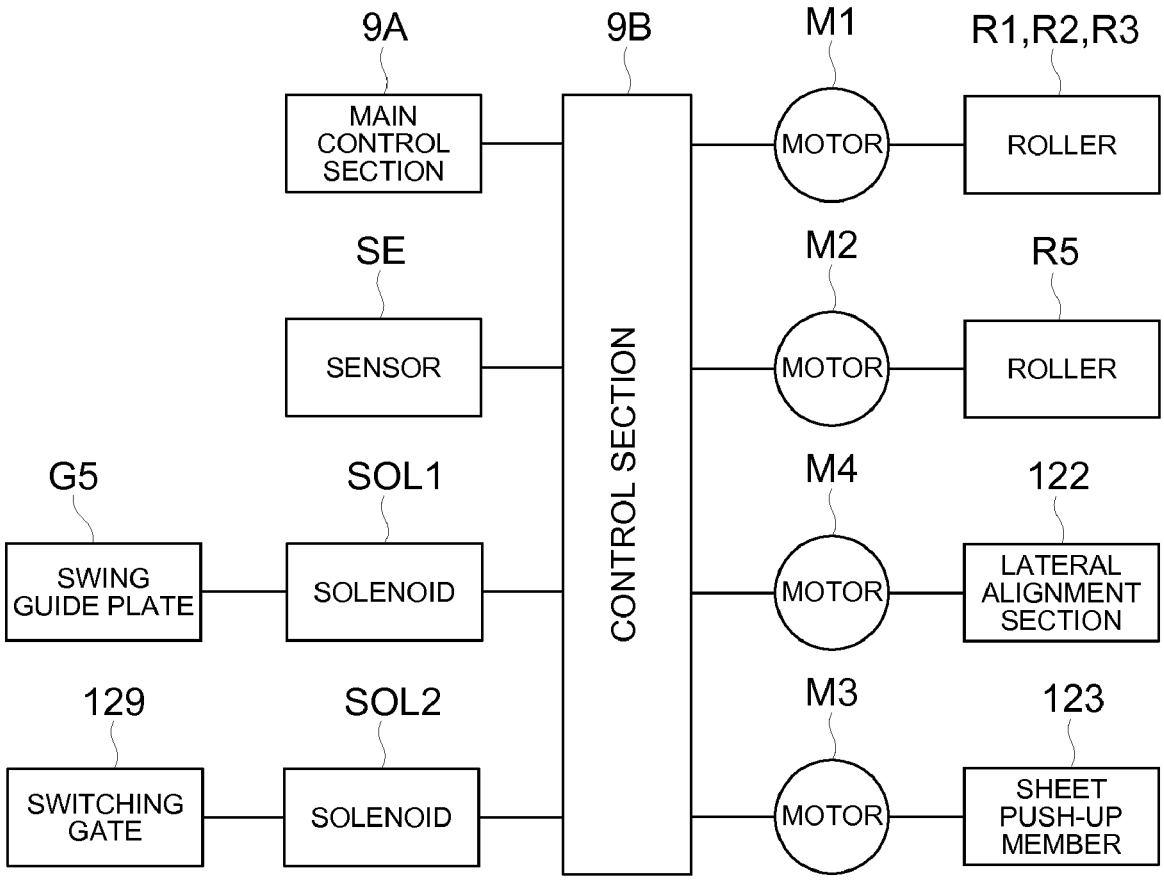
FIG. 14 is a block diagram of the control system of the intermediate conveyance unit B according to an embodiment of the present invention.
Figure 15:
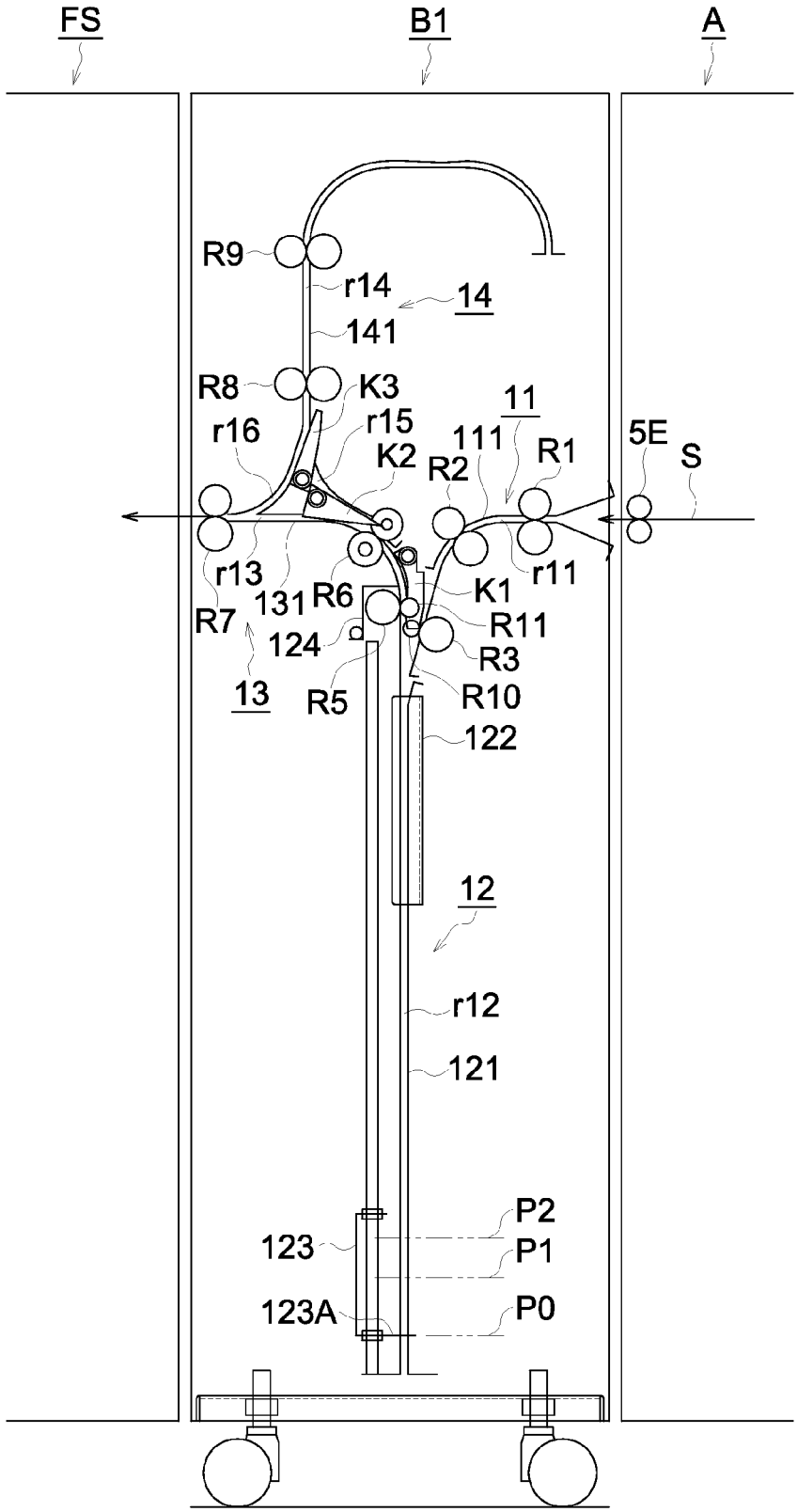
FIG. 15 is a front cross sectional view of the intermediate conveyance unit B1 provided with a sheet alignment apparatus disclosed in the Unexamined Japanese Patent Application Publication No. 2007-137536.

The lateral alignment section 122 aligns the sheets S in the width direction. As is well known, the sheets S are sandwiched in the width direction, and the reciprocal motion is provided by the motor M4 (FIG. 4 and FIG. 14), whereby sheets S are aligned The stored-sheet conveyance section (no reference numeral) moving the sheets S of the sheet storage section 12 in the vertical direction includes a motor M3, a belt 125, and a guide rod 126. The sheet push-up member 123 is connected to the belt 125, and is guided by the vertical guide rod 126 to move in the vertical direction in response to the rotation of the belt which is driven by the motor M3 (FIG. 2*a* and FIG. 14). As will be described later, the sheet push-up member 123 moves from the initial stop position P0 to the first stop position P1, the second stop position P2, and third stop position P3 in the sheet conveyance process. In addition, the sheet push-up member 123 is configured to be able to change the stop positions in conformity to the size of the sheet. Further, as shown in FIG. 2*b*, the sheet abutting plate 123A is abutted on the leading edge, in the sheet carry-in direction, of the sheets S carried-in from the sheet carry-in section 11, and is bonded on the upper side of the bottom part of the sheet push-up member 123 through the elastic member 123B. The sheet push-up member 123 moves the sheets S by pushing up the trailing edge, in the sheet discharge direction, of the sheets S placed on the sheet abutting plate 123A.

The sheet discharge unit 13 includes a pair of guide members 120 for guiding the sheets S, guide members G3 and G4 as a branched guide section, a discharge drive roller R5, a driven roller R5*a*, and a pair of rollers R6 and R7.

A pair of rollers as a sheet discharge section of the present invention are made up of the discharge drive roller R5 and the driven roller R5*a*. The discharge drive roller R5 is an elastic roller made up of a rubber roller with a high friction coefficient, and is connected to and driven by a motor M2 that can rotate in forward and reverse directions as a carry-in roller drive section. The driven roller R5*a* is a rigid roller made of metal or resin having a low friction coefficient that is lower than that of the discharge drive roller R5. This driven roller R5*a* is pressed against the discharge drive roller R5, and is turned following the rotation of the discharge drive roller R5. A nip portion is formed by the pressure contact between the discharge drive roller R5 and the driven roller R5*a* as a pair of rollers. The sheet S is sandwiched by the nip portion and is discharged from the sheet storage section 12 in a switched-back state. The reference numeral 129 is a switching gate to select whether sheets S are conveyed in the horizontal direction or to the sheet storage section 12. This gate is driven and swung by the solenoid SOL2 (FIG. 2*a* and FIG. 14).

The projection G4*a* as a projection member according to the present invention formed on the guide member G4 guide the leading edge of the sheet S fed upward by the rise of the sheet push-up member 123 toward the driven roller R5*a* instead of the discharge drive roller R5. The following describes the purpose and function of the projection G4*a* formed on the guide member G4.

The sheets S are aligned in the sheet conveyance direction (longitudinal alignment) between the discharge drive roller R5 and the driven roller R5*a* forming the nip portion, and the sheet abutting plate 123A arranged on the bottom portion of the sheet push-up member 123A. However, if the longitudinal alignment is started when the rotation of the discharge drive roller R5 is suspended, the leading edge of the sheet S may be caught in the nip portion.

In the meantime, in order to prevent the sheet conveying efficiency from being reduced, it is important to draw back the position of the conveyed sheet S in the sheet conveyance direction as little as possible. Therefore, it is preferable to perform the longitudinal sheet alignment and the lateral sheet alignment at the same position. However, if the position for longitudinal sheet alignment is the same as the position for lateral sheet alignment, the leading edge of the sheet S may be caught in the nip portion at the time of longitudinal alignment as described above, and this may adversely affect the lateral alignment.

To solve this problem, according to the embodiment, the discharge drive roller R5 is driven in the reverse direction so that the leading edge of the sheet S is prevented from being caught in the nip portion. Further, the position of the trailing edge of the sheets S is regulated by the sheet abutting plate 123A, so that the sheets S do not get back from the position in the sheet conveyance direction. Thus, in the embodiment, the longitudinal alignment and lateral alignment are performed at almost the same position so that the sheet conveying efficiency is not reduced.

When the leading edge of the sheet S conveyed by the sheet push-up member 123 comes close to the discharge drive roller R5, which stops rotating, the motor M3 starts reverse rotation to drive the discharge drive roller R5 in the reverse direction.

If the leading edge of the sheet S has abutted on the discharge drive roller R5 rotating in the reverse direction, a large frictional drag will be applied to the leading edge of the sheet, and the leading edge of the sheet may buckle or be contaminated.

In the embodiment, in order to solve this problem, the projections G4*a* are designed to have a width corresponding to the width of the discharge drive roller R5, and the layout and shape of the projections G4*a* are designed in such a way that the leading edge of the sheet S being conveyed will move toward the driven roller R5*a*. Thus, this structure prevents the leading edge of the sheet from directly abutting on the discharge drive roller R5. The sheet reaches the nip portion along the surface of the driven roller R5*a* that has a small frictional coefficient when the conveying operation of the sheet push-up member 123 is suspended. This arrangement reduces the frictional drag on the leading edge of the sheet, with the result that the leading edge of the sheet is protected from the aforementioned buckling and contamination.

Referring to FIGS. 2*c* and 3, the following describes the structure of the projections G4*a* of the embodiment in greater detail.

FIG. 3 is a view in the direction of the arrow A in FIG. 2*c*, and illustrates the structure of the projections G4*a* on the guide member G4. In FIG. 3, the guide member G4 is provided with by-pass holes G4*b* for preventing the interference between the discharge drive roller R5 and the driven roller R5*a* that are pressed against each other. The reference symbol "Y" indicates the sheet discharge direction.

The projections G4*a* of the embodiment protrude from the aforementioned by-pass holes G4*b* toward the inside of the sheet discharge path formed between the by-pass holes G4*b* and the guide member G3, as shown in FIG. 2*c*. The width L2 is almost the same as the length L1 of the roller portion of the corresponding discharge drive roller R5. Although L1<L2 in the present embodiment, the magnitude relation is not important as long as the values are approximately the same.

In the present embodiment, the projections G4*a* are formed integrally with the guide member G4. However, the projections G4*a* can be separately formed such that the position and amount of protrusion can be adjusted in conformity to the size and type of the sheet S.

Since the projections G4*a* of the embodiment are protruded from the guide member G4, the leading edge of the sheets being conveyed is prevented from directly abutting on the discharge drive roller R5 with a high friction coefficient which rotates in the reverse direction, with the result that the leading edge of the sheet is protected from buckling and contamination.

FIG. 4 is a schematic diagram representing the lateral alignment section 122. The lateral alignment section 122 includes a pair of lateral alignment plates 122A on the right and left, a motor M4, a belt 127, and pins 128A and 128B. A pair of the lateral alignment plates 122A are reciprocally moved by the motor M4 that can rotate in the forward and reverse directions. The pins 128A and 128B engaging with the rotating belt 127 reciprocally move in the sheet width direction, so that the sheets S are aligned in the width direction.

[Operation of Intermediate Conveyance Unit B]

The following describes the operation of the intermediate conveyance unit B with reference to FIG. 5 through FIG. 14.

Figure 5:
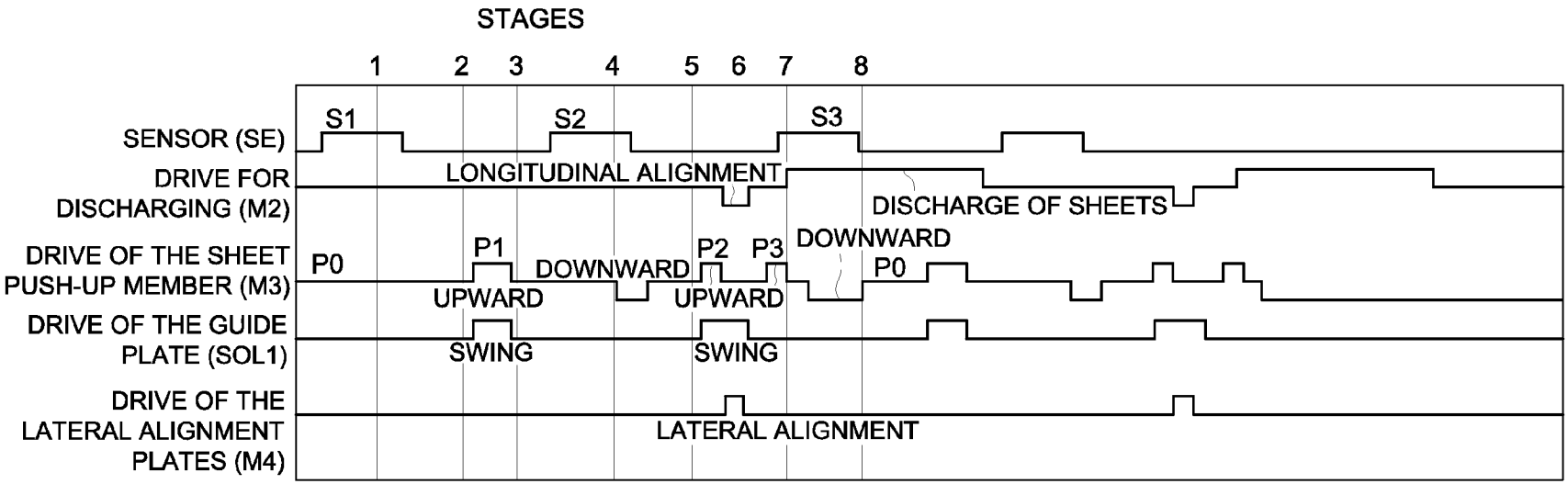
FIG. 5 is an operation timing chart of the intermediate conveyance unit B according to an embodiment of the present invention.

FIG. 5 is an operation timing chart of the intermediate conveyance unit B. FIGS. 6 through 13 are front cross sectional views of the intermediate conveyance unit B, showing the stages 1 through 8 in the sheet conveying operation. FIG. 14 is a block diagram of the control system of the intermediate conveyance unit B.

The control section 9B installed on the intermediate conveyance unit B controls timings as shown in FIG. 5, on the basis of the information fed from the main control section 9A of the image forming apparatus and the sheet detection signal of the sensor SE of the sheet carry-in section 11. The starting time of each part of FIG. 5 is determined based on the sheet detection signal of the sensor SE. In reference to FIG. 5, the drive for discharging refers to the operation of the motor M2 to drive the discharge drive roller R5, and the drive of the sheet push-up member refers to the operation of the motor M3 as a sheet push-up member drive section to drive the sheet push-up member 123 up and down. Further, in the drive of the guide plate, the solenoid SOL1 as a guide plate driving section is driven to change the position of the swing guide plate G5 in the sheet conveyance path. A pair of rollers R1 and R2 and carry-in drive roller R3 are rotated on a continuous basis by the motor M1.

The operation of the drive of the sheet push-up member in FIG. 5 illustrates the forward rotation (upward), the reverse rotation (downward), and stop of the motor M3. The drive of the sheet push-up member is set as follows: in the initial state, the sheet push-up member 123 is located at the initial stop position P0 of FIG. 6 (stage 1 through 2); when the motor M3 moves upward in the stages 2 through 3, the sheet push-up member 123 moves from the initial stop position P0 to the height of the first stop position P1 of FIG. 8 (stages 3 through 4); when the motor moves upward in the stages 5 through 6, the sheet push-up member 123 goes upward to the second stop position P2 of FIG. 11; when the motor moves upward in the stages 6 through 7, the sheet push-up member 123 goes upward to the third stop position P3 of FIG. 12; and when the motor moves downward in the stages 4 through 5, and stage 7 through 8, the sheet push-up member 123 returns to the initial stop position P0 of FIG. 10 and FIG. 13.

In the present embodiment, the initial stop position P0, the first stop position P1, the second stop position P2, and third stop position P3 change in conformity to the size (length in the sheet conveyance direction) of the sheet S being used. Further, the second stop position P2 is set in such a way that, when the leading edge of the sheet S being used reaches the inlet of the nip portion formed by the discharge drive roller R5 and the driven roller R5*a*, the sheet abutting plate 123A provided on the sheet push-up member 123 is in contact with the trailing edge of the sheets S.

The longitudinal alignment is performed by the movement of the sheet push-up member 123 to the second stop position P2 in the stages 5 through 6 of the drive operation of the sheet push-up member in FIG. 5. The longitudinal alignment refers here to the process in which the leading edges or the trailing edges of the sheets S are aligned in the sheet conveyance direction. The procedure of the longitudinal alignment according to the embodiment is as follows. The leading edges of the sheets S moved in the sheet discharge direction by the sheet push-up member 123 first abuts on the nip portion formed by the discharge drive roller R5 and the driven roller R5*a* rotating in the reverse direction. When the leading edges, in the sheet discharge direction, of the sheets S have abutted on the nip portion, the leading edges of the sheets are aligned (longitudinal alignment), and the inclination of the sheet S is also corrected. In the meantime, the leading edges, in the sheet discharge direction, of the sheets S are kept slightly apart from the nip portion formed by the discharge drive roller R5 and the driven roller R5*a* by the reverse rotation of the discharge drive roller R5. In this state, the trailing edges of the sheets S are kept abutted on the sheet abutting plate 123A of the sheet push-up member 123. Pressure on the sheets S applied by the leading edges of the sheets S being kept apart from the nip portion is absorbed by the deformation of the elastic member 123B bonded on the upper surface of the bottom portion of the sheet push-up member 123 and the warp of the sheets S.

Figure 6:
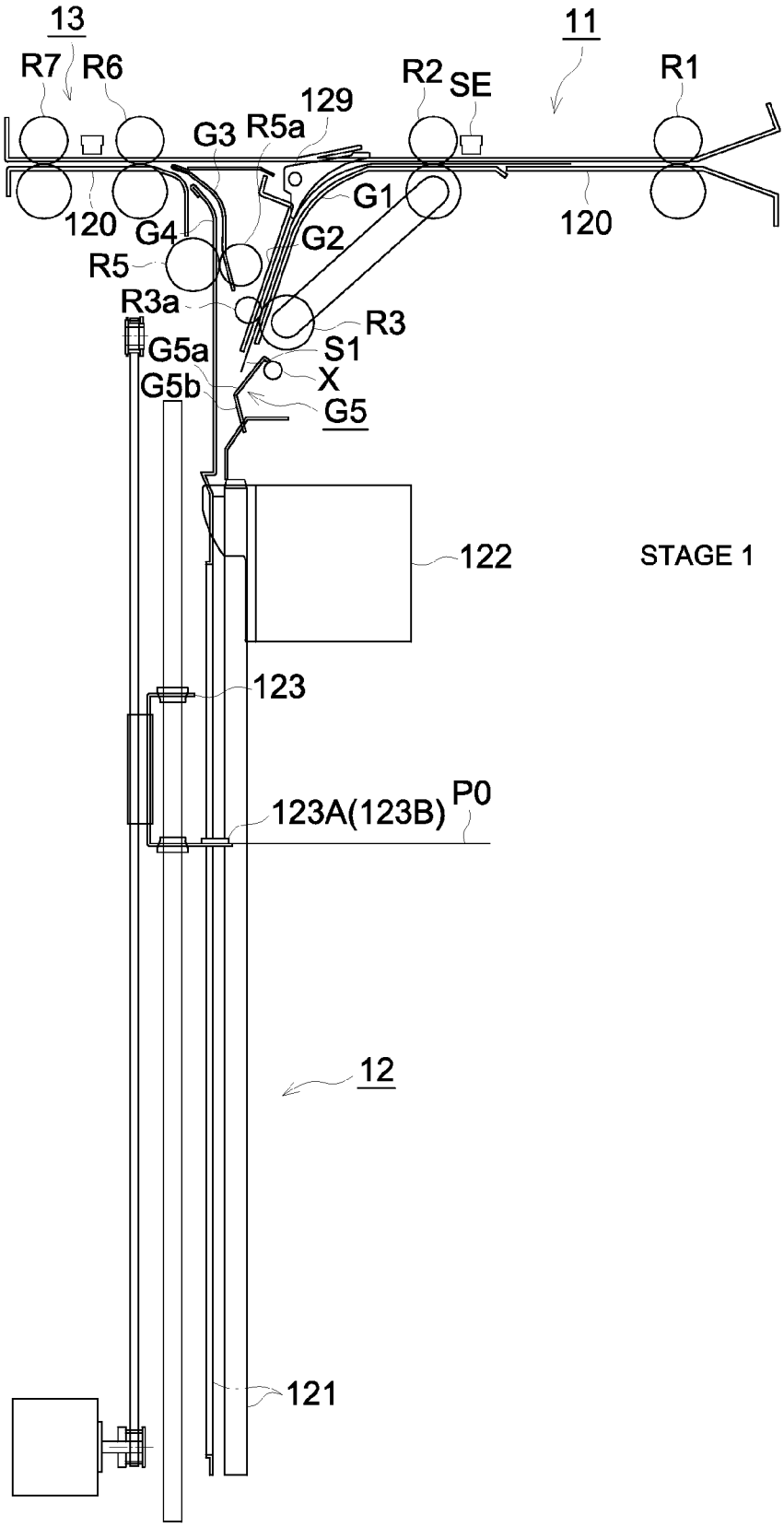
FIG. 6 is a front cross sectional view of the intermediate conveyance unit B according to an embodiment of the present invention.

As shown in FIG. 6, the first sheet (the preceding sheet) S1 ejected from the image forming apparatus main body A is conveyed through the sheet carry-in section 11 in the horizontal direction by a pair of rollers R1 and R2, and the sheet S1 is then detected by the sensor SE (stage 1). In the sheet carry-in stage of FIG. 6, the pair of rollers R1 and R2 and the carry-in drive roller R3 are driven and rotated by the motor M1. The carry-in drive roller R3 and the pressure contacted driven roller R3*a* sandwich and convey the sheet S1. While the first sheet S1 is conveyed from the sheet carry-in section 11 to the sheet storage section 12, the sheet S1 is guided by the guide members G1 and G2, swing guide plate G5, and sheet retainer plate 121. The swing guide plate G5 remains, having been moved in the counterclockwise direction, and the sheet S carried in from the carry-in drive roller R3 is received by the sheet guide section G5*a*, and is guided to the sheet storage section 12.

Figure 7:
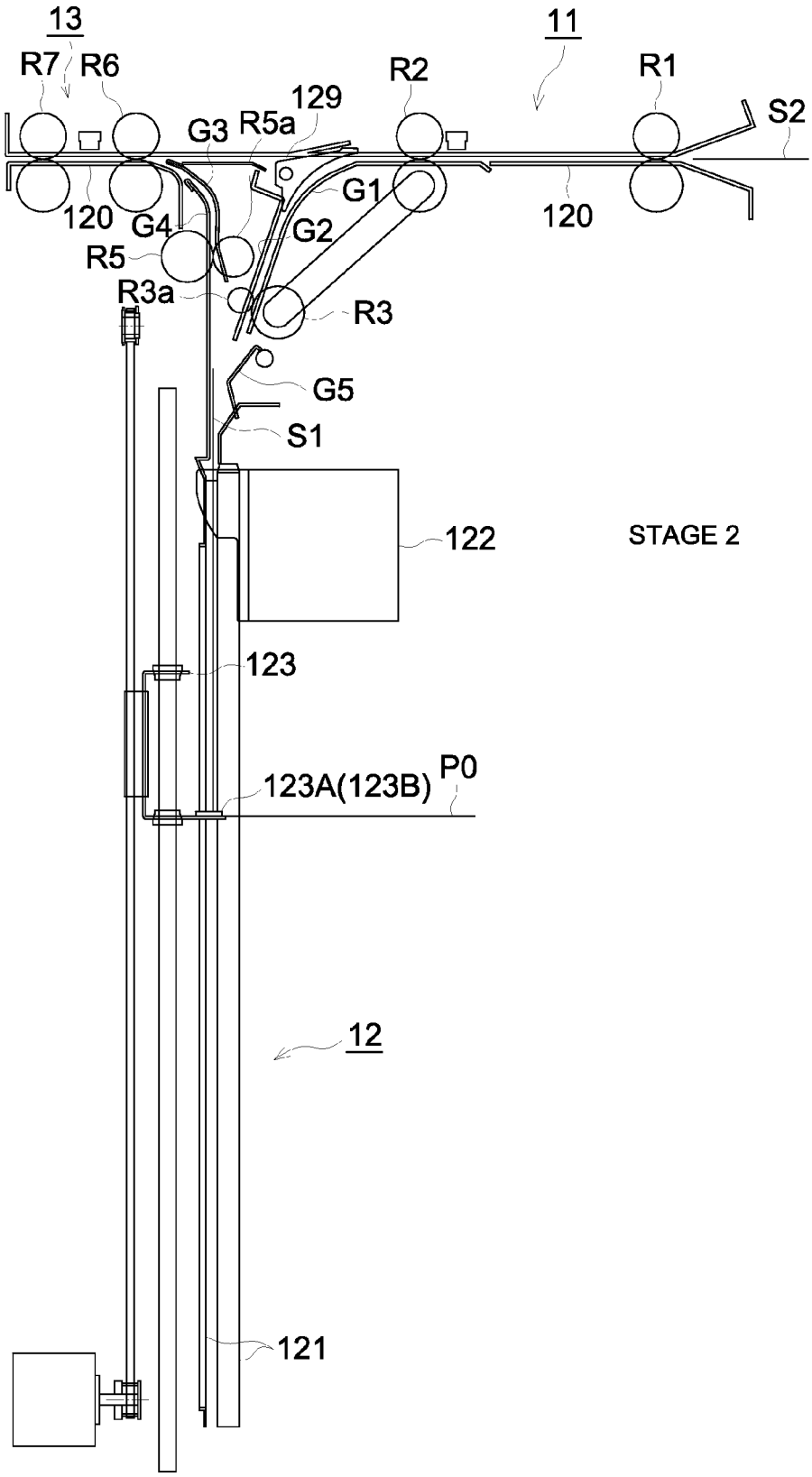
FIG. 7 is a front cross sectional view of the intermediate conveyance unit B according to an embodiment of the present invention.

As a result of the sheet being carried in as shown in FIG. 6, the leading edge of the first sheet S1 in the sheet carry-in direction is stopped by being abutted on the sheet abutting plate 123A provided on the sheet push-up member 123, as shown in FIG. 7 (stage 2). At this time, the sheet push-up member 123 is located at the initial stop position P0.

The motor M3 then starts forward rotation. Thus, the sheet push-up member 123 is moved upward through the belt 125, and is stopped at the first stop position P1 illustrated in FIG. 8 (stage 3). When the sheet push-up member 123 goes up, the solenoid SOL1 is activated, as shown in FIG. 5, and the swing guide plate G5 rotationally moves in the clockwise direction to reach the position of FIG. 8. It should be noted that the sheet S1 is reversed in direction in the sheet storage section 12, so that the leading edge in the sheet discharge direction corresponds to the trailing edge in the sheet carry-in direction. When the swing guide plate G5 rotationally moves in the clockwise direction and the bottom end of the swing guide plate G5 comes close to the wall surface of the guide member G4, the sheet S1 is guided by the swing guide plate G5, and is conveyed along the wall surface of the guide member G4.

Since the swing guide plate G5 is moved clockwise, the leading edge, in the discharge direction, of the sheet S1 is guided along the wall surface of the guide member G4. This arrangement prevents occurrence of conveyance failure such as the sheet abutting on the bottom end of the guide member G3 or away from the guide member G3.

When the sheet push-up member 123 has reached the first stop position P1, the leading edge, in the discharge direction, of the sheet S1 is located above the bottom end of the guide member G2; thus even when the second sheet S2 has been carried in from the guide members G1 and G2, there is no interference between the leading edges of the first sheet S1 and the second sheet S2. To be more specific, the second sheet S2 as the succeeding sheet is prevented from interrupting the first sheet S1 as the preceding sheet (entry to the left side of the first sheet S1 in FIG. 8). When the sheet push-up member 123 has reached the first stop position P1, the leading edge, in the sheet discharge direction, of the sheet S1 is located below the nip portion formed by the discharge drive roller R5 and driven roller R5*a*.

Figure 9:
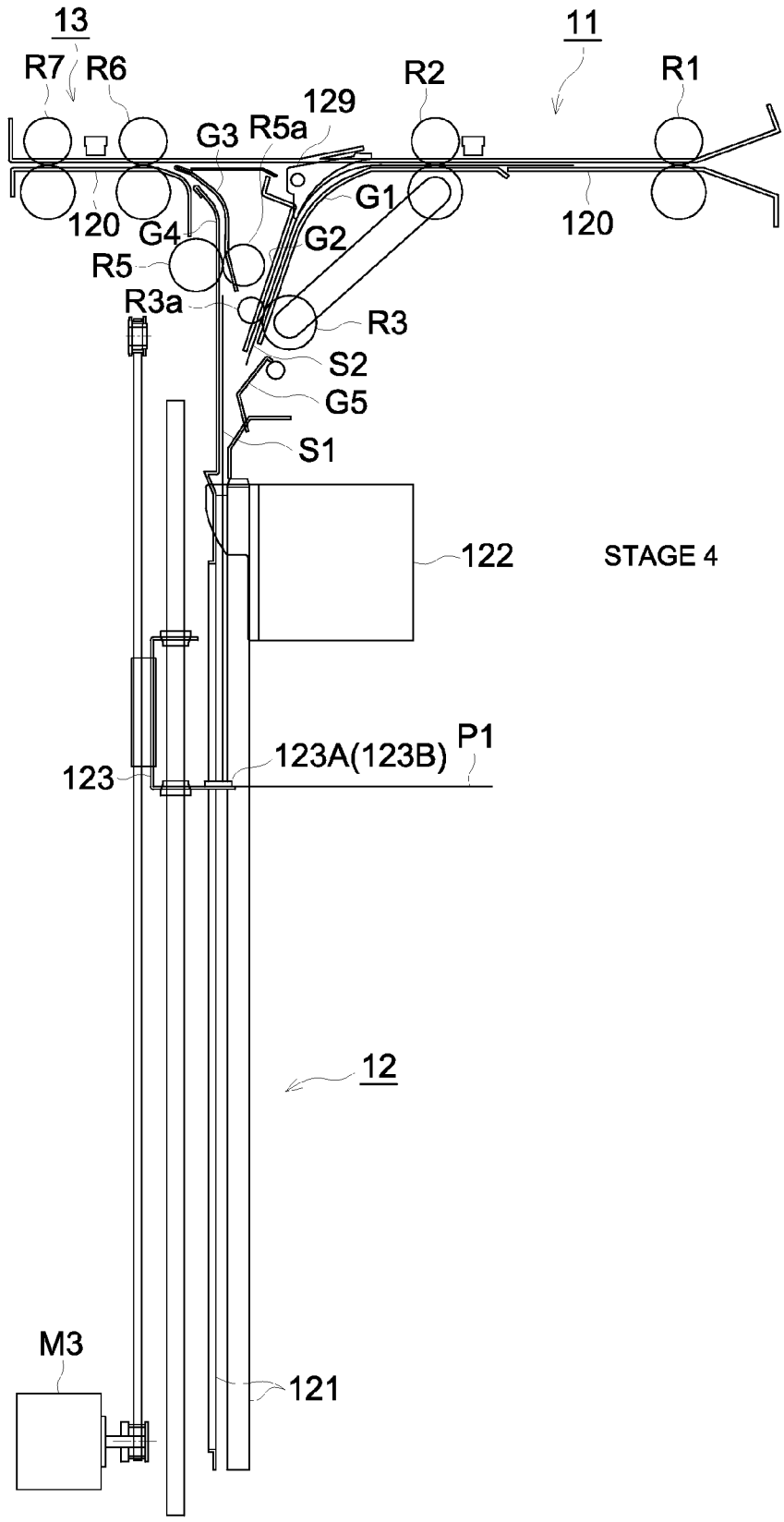
FIG. 9 is a front cross sectional view of the intermediate conveyance unit B according to an embodiment of the present invention.
Figure 10:
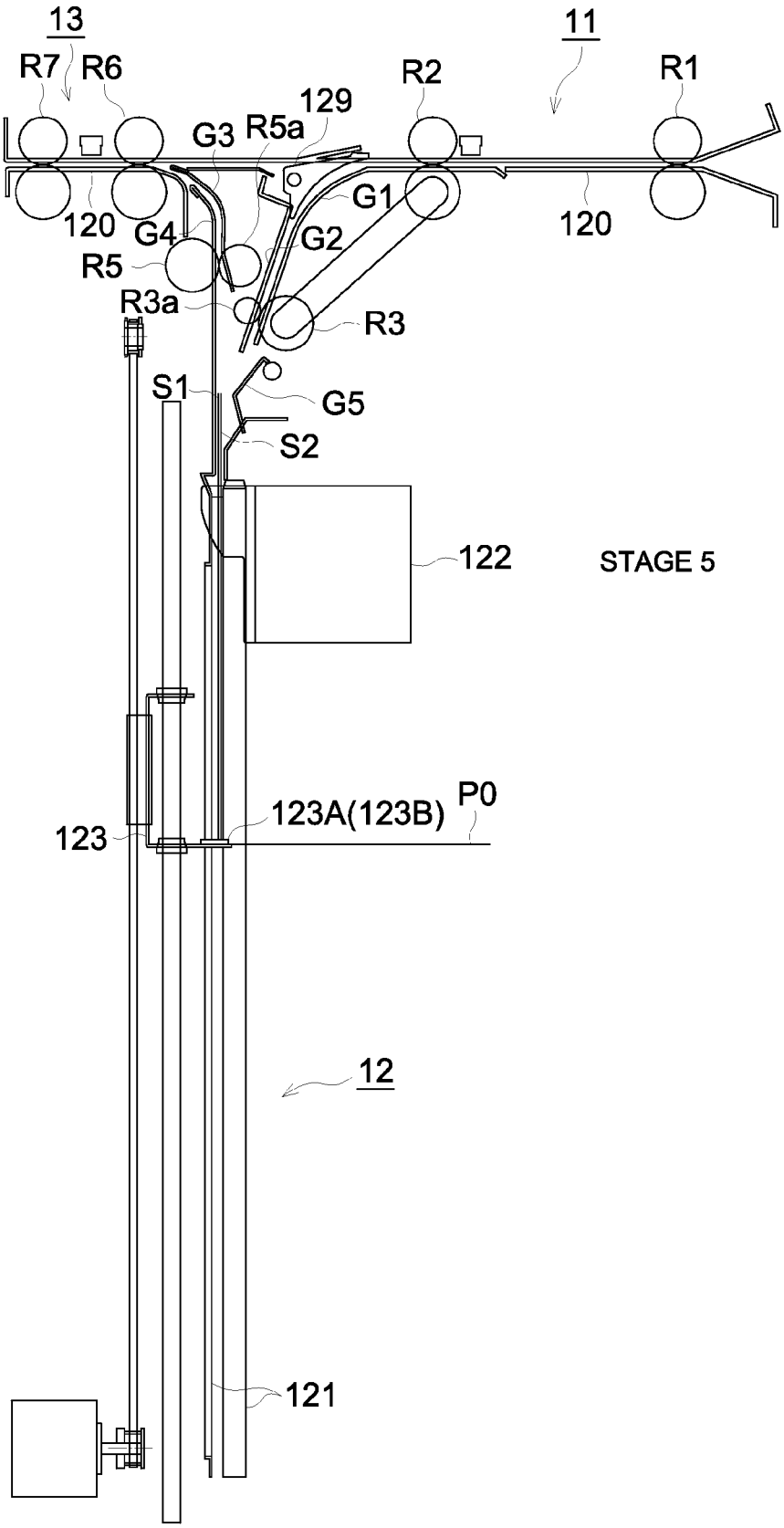
FIG. 10 is a front cross sectional view of the intermediate conveyance unit B according to an embodiment of the present invention.

Then, the intermediate conveyance unit B goes into the state shown in FIG. 9 (stage 4). In FIG. 9, the second sheet (the succeeding sheet) S2 is sandwiched by the roller pair R2, the carry-in drive roller R3 and the driven roller R3*a*, and is guided by the guide members G1 and G2. The second sheet S2 goes on the right side of the first sheet S1 in FIG. 9 without the leading edge in the sheet carry-in direction interfering with the leading edge, in the sheet discharge direction, of the first sheet S1. The second sheet S2 is conveyed until the second sheet S2 abuts on the sheet abutting plate 123A provided on the sheet push-up member 123. After that, the sheets S1 and S2 are stored stacked on the sheet push-up member 123.

Since the sheet push-up member 123 moves the first sheet S1 upward and stops at the first stop position P1, the sheet S2 being loaded next is stored in the sheet storage section 12 such that the leading edge of the second sheet S2 does not interfere with the leading edge, in the sheet discharge direction, of the first sheet S1.

As shown in the timing chart of FIG. 5, the sheet push-up member 123 is lowered by the reverse rotation of the motor M3 immediately after stage 4 and receives the sheet S2 placed on top of sheet S1. The sheet push-up member 123 then goes to the initial stop position P0, which state is the state of stage 5 of FIG. 10. The state of FIG. 10 (stage 5) is approximately the same as the state of FIG. 7. In FIG. 7, only the first sheet S1 is held by the sheet push-up member 123, but two sheets S1 and S2 are held in FIG. 10.

Figure 8:
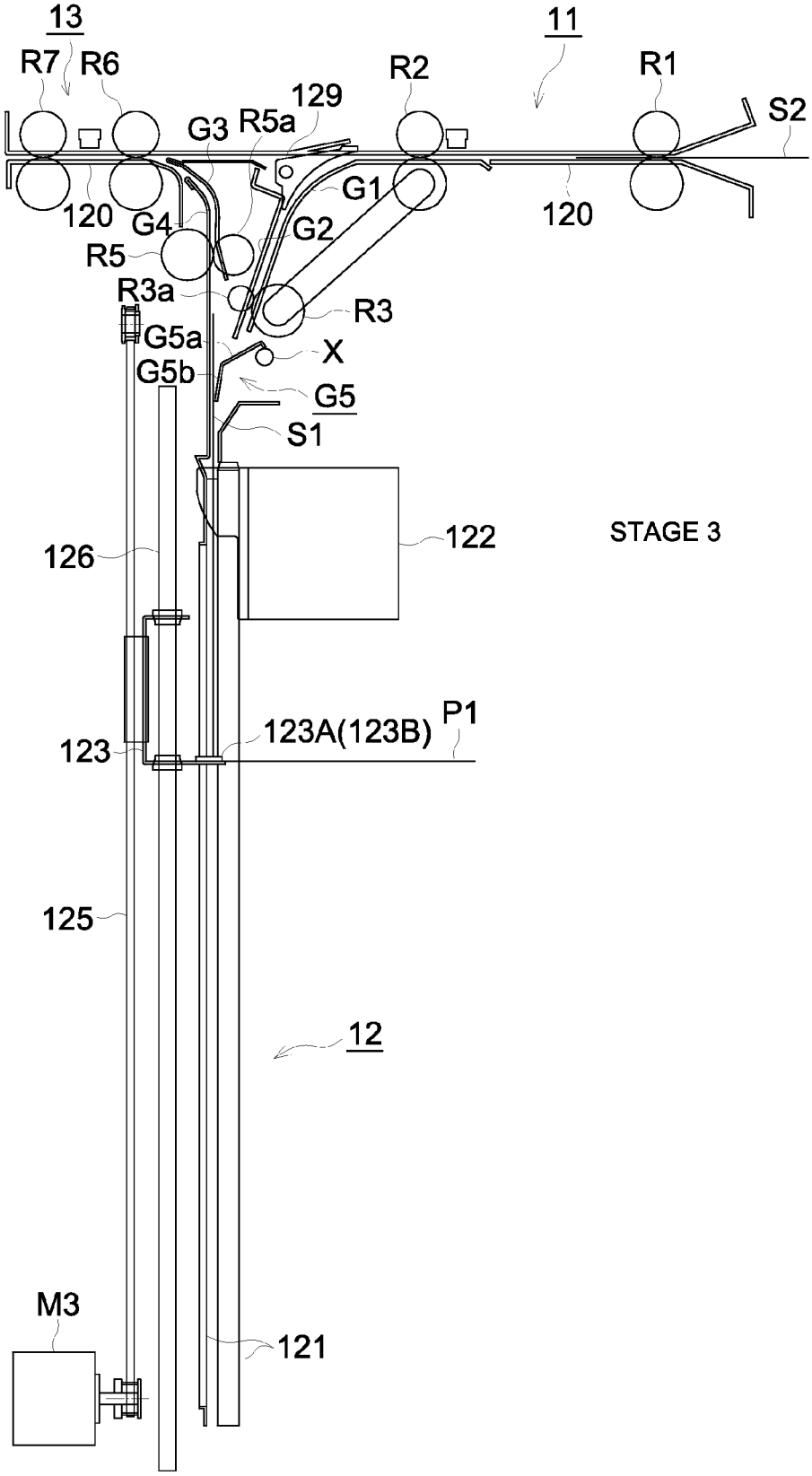
FIG. 8 is a front cross sectional view of the intermediate conveyance unit B according to an embodiment of the present invention.
Figure 11:
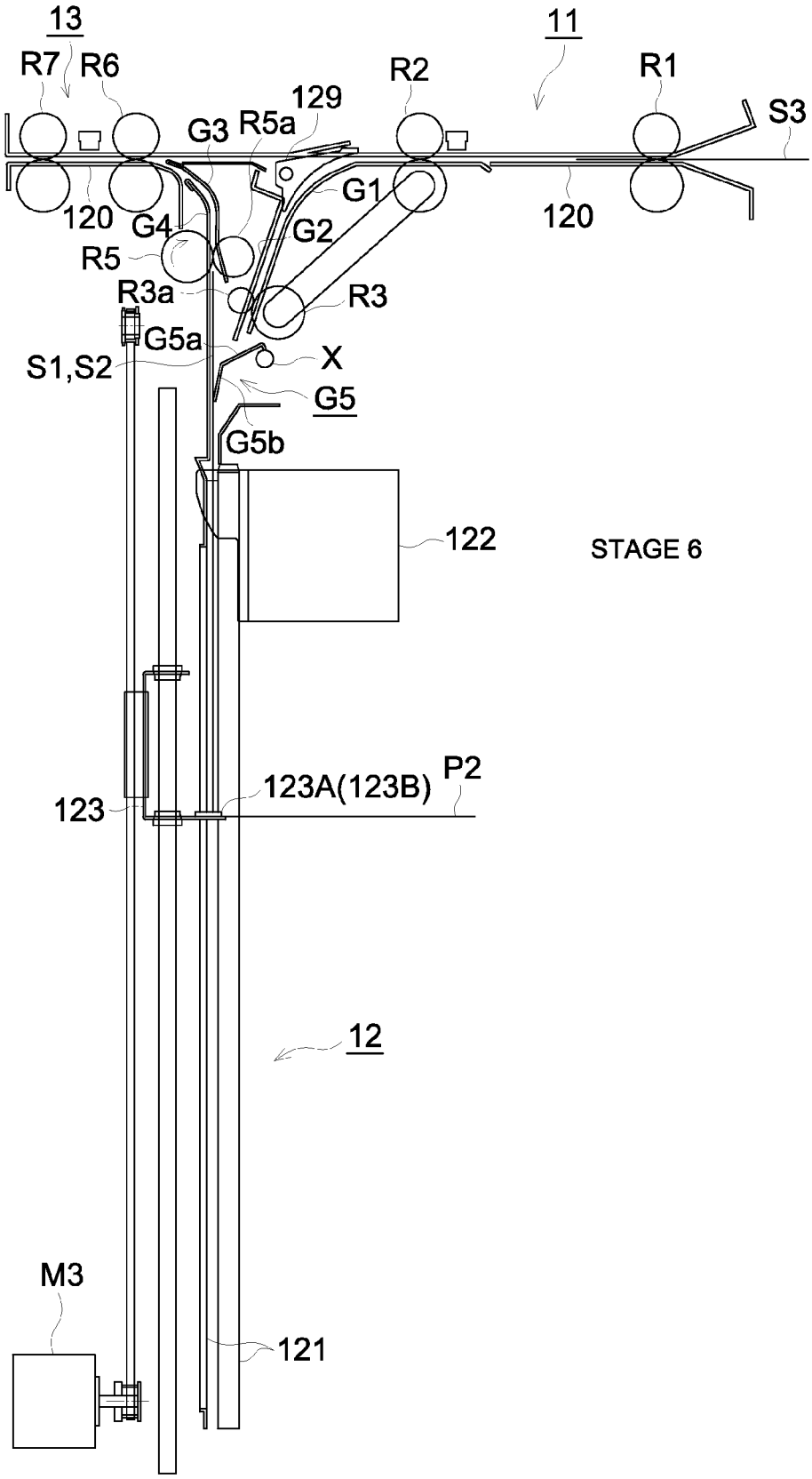
FIG. 11 is a front cross sectional view of the intermediate conveyance unit B according to an embodiment of the present invention.

The motor M3 operates immediately after stage 5, and the sheet push-up member 123 goes upward. Then the sheet push-up member 123 is moved up toward the second stop position P2 (stage 6), as shown in FIG. 11. At this time, the solenoid SOL1 is driven almost at the same time as shown in FIG. 5, and the swing guide plate G5 is moved in the clockwise direction to reach the position in FIG. 11. In FIG. 11, the swing guide plate G5 is positioned in the same state as shown in FIG. 8, namely, the bottom end of the swing guide plate G5 is positioned closer to the wall surface of the guide member G4. Thus, the leading edges, in the discharge direction, of the sheets S1 and S2 are also guided along the wall surface of the guide member G4, and the sheets S1 and S2 are properly guided and conveyed by the guide member G3.

As shown in FIG. 5, immediately before the sheet push-up member 123 reaches the second stop position P2, the motor M2 performs a reverse rotation so that the discharge drive roller R5 is turned in the reverse direction. When the sheet push-up member 123 has reached the second stop position P2, the leading edges of the sheets S1 and S2 reach the inlet of the nip portion of the discharge drive roller R5 and the driven roller R5*a* rotating in the reverse direction, and simultaneously the rotation of the motor M3 is suspended and the sheet push-up member 123 is stopped at the second stop position. In this step, the leading edges of the sheets S1 and S2 conveyed along the wall surface of the guide member G4 toward the inlet of the nip portion are guided by the projections G4*a* formed on the guide member G4, are conveyed toward the driven roller R5*a*, move along the surface of the driven roller R5*a*, and reach the inlet of the nip portion. Since the discharge drive roller R5 rotates in the reverse direction as shown in FIG. 11, the leading edges of the two sheets S1 and S2 are slightly separated from the nip portion, and the trailing edge of the two sheets S1 and S2 are pressed against the sheet abutting plate 123A provided on the sheet push-up member 123. Thus, the two sheets S1 and S2 are aligned in the sheet conveyance direction (longitudinal alignment) with the leading edges kept away from the nip portion, and the inclination is also corrected.

When the two sheets S1 and S2 are pressed against the sheet abutting plate 123A, the elastic member 123B is deformed since the sheet abutting plate 123A is bonded to the sheet push-up member 123 through the elastic member 123B.

This deformation reduces the pressure applied to the sheets S1 and S2. While the discharge drive roller R5 is turning in the reverse direction, the leading edges of the two sheets S1 and S2 are kept apart from the nip portion and are not sandwiched by the nip portion. Further, if flexible firm sheets S are used, the deformation of the elastic member 123B is small and the leading edges of the sheets are kept apart from the nip portion, and the two sheets S1 and 52 warp between two guide plates 121.

According to the present embodiment, the sheet abutting plate 123A is disposed through the elastic member 123B. This structure ensures that a fluctuation in the size of the sheet S (length in the sheet conveyance direction), if any, will be absorbed by the deformation of the elastic member 123B. This ensures separation of the leading edges of the sheets S from the nip portion and positioning of the sheets during the longitudinal alignment.

In the meantime, when the discharge drive roller R5 is rotated in the reverse direction and the leading edges of the sheets are kept apart from the nip portion, the motor M4 is driven to operate the lateral alignment section 122 so that two sheets S1 and S2 are aligned in the width direction (FIG. 4 and FIG. 5). Further, the third sheet S3 is also carried in by the roller pair R1.

In the embodiment, the reverse rotation of the discharge drive roller R5 enables the leading edges of the sheets S to be separated from the nip portion and enables the lateral alignment section 122 to perform the lateral alignment smoothly and simultaneously with the longitudinal alignment, with the result that sheet conveyance efficiency is enhanced.

Figure 12:
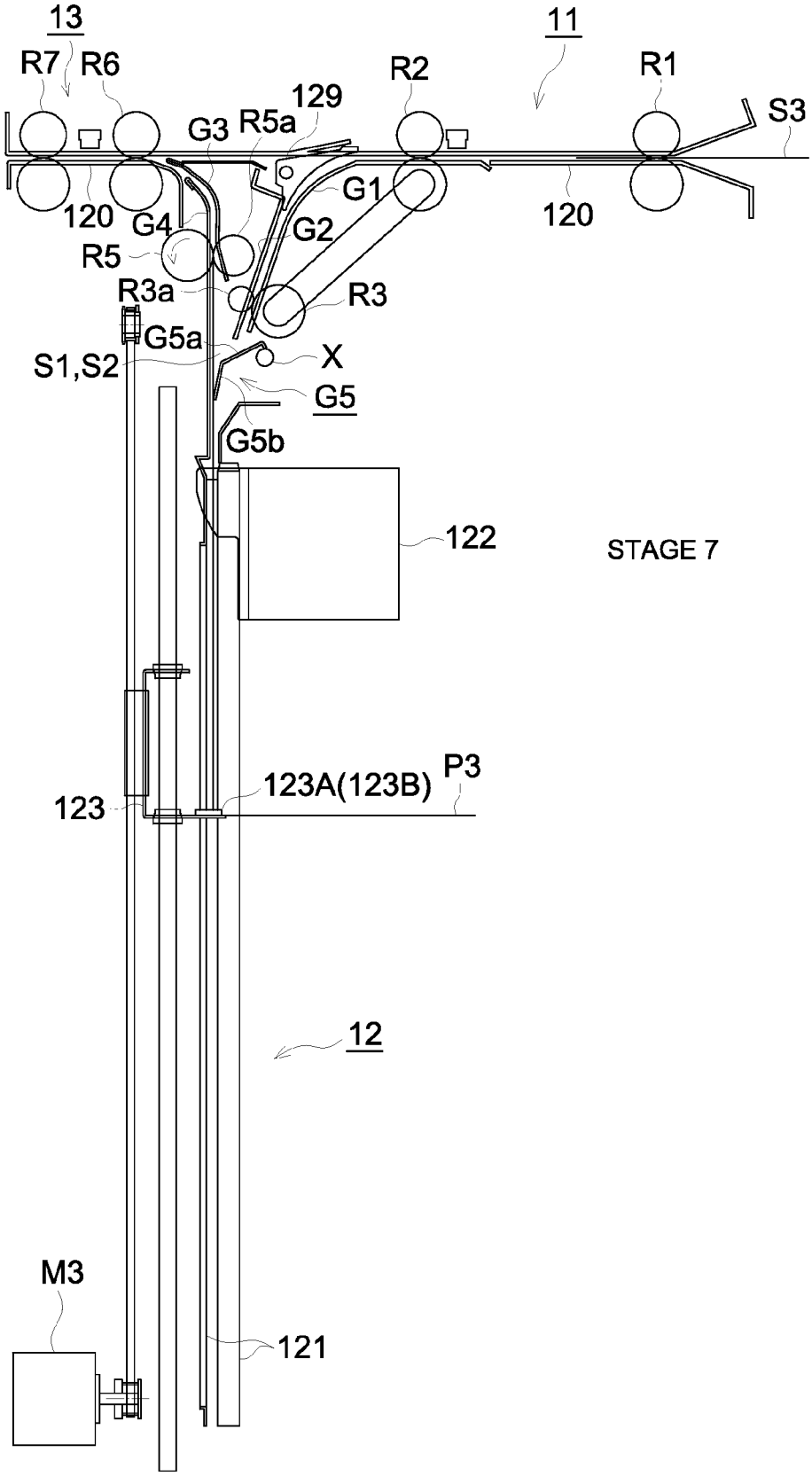
FIG. 12 is a front cross sectional view of the intermediate conveyance unit B according to an embodiment of the present invention.
Figure 13:
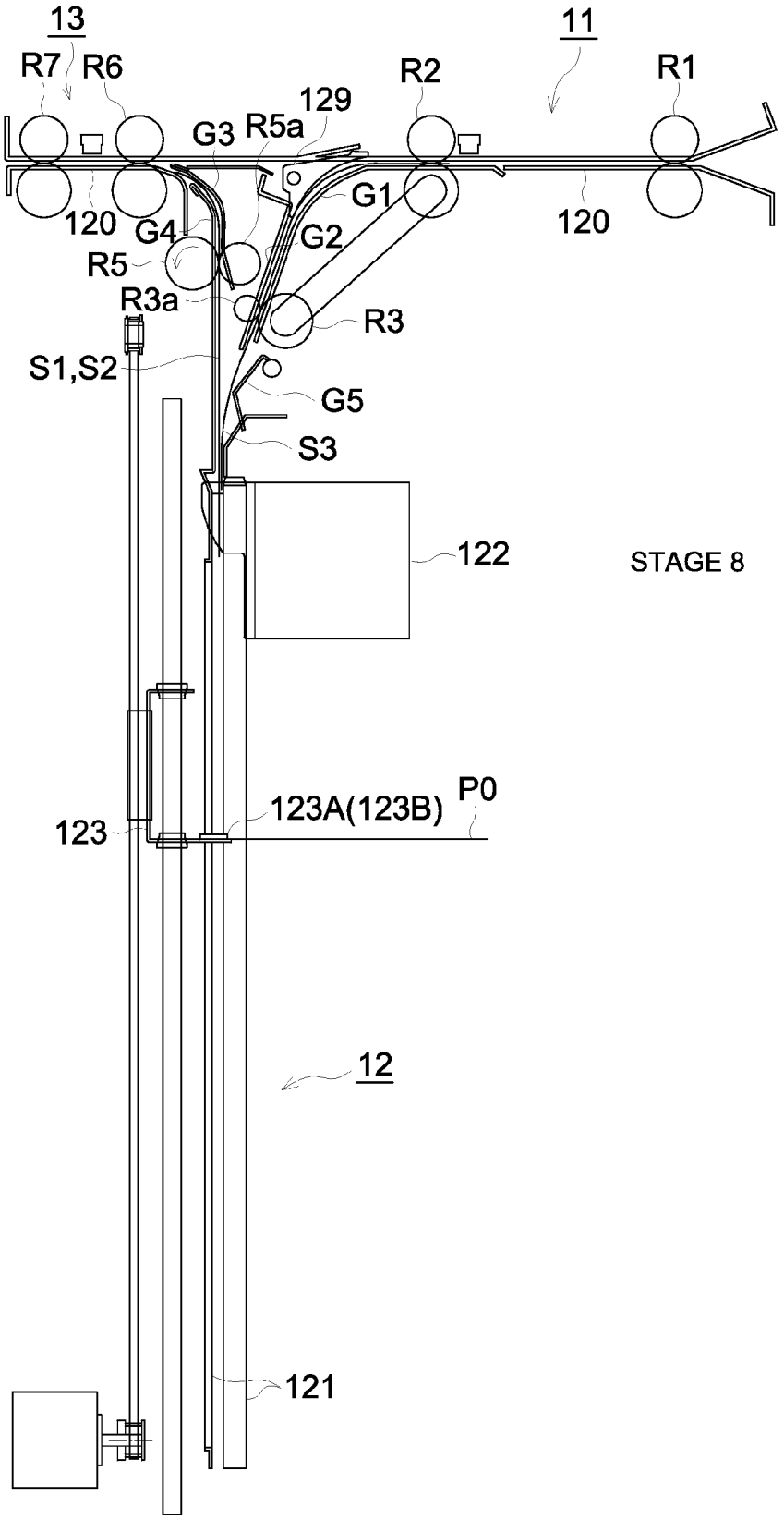
FIG. 13 is a front cross sectional view of the intermediate conveyance unit B according to an embodiment of the present invention.

Then the sheet push-up member 123 goes further upward from the second stop position P2 of stage 6 and reaches the third stop position P3 of FIG. 12, and the sheet push-up member 123 is stopped (stage 7). In stage 7, almost simultaneously with the rise of the sheet push-up member 123, the discharge drive roller R5 starts rotating in the forward direction. The sheets S1 and S2 are sandwiched by the nip portion between the discharge drive roller R5 and the driven roller R5*a* and are fed toward the guide member 120 of the sheet discharge unit 13. In the meantime, the third sheet S3 is sandwiched by the roller pair R1, and is carried into the sheet carry-in section 11.

When the sheets S1 and S2 are fed, being sandwiched by the discharge drive roller R5 rotating in the forward direction, the sheet push-up member 123 is lowered by the reverse rotation of the motor M3, and is returned to the initial stop position P0, and the sheet push-up member 123 stops (stage 8). In the meantime, the third sheet S3 is fed by the roller pair R2 and the carry-in drive roller R3, and is carried into the sheet storage section 12.

Almost at the same tame when the third sheet S3 is carried into the sheet storage section 12 by the carry-in drive roller R3, the motor M3 operates to lower the sheet push-up member 123 to the initial stop position P0. Along with the lowering of the sheet push-up member 123, the roller pair R2 is rotated, and the third sheet S3 is conveyed through the guide members G1 and G2 toward the sheet push-up member 123 that moves to the initial stop position P0.

Stages 1 through 8 shown in FIGS. 6 through FIG. 13 are repeatedly performed, and the continuous conveyance is performed in which the sheets S are carried into the intermediate conveyance unit B one by one and discharged two by two.

In the present embodiment, the number of sheets S stored in the sheet storage section 12 is two. However, it goes without saying that one or three or more sheets can be stored in the sheet storage section 12, and can then be ejected therefrom.

According to the embodiment, before sheet lateral alignment is started, the leading edges of the sheets are kept apart from the nip portion formed by a pair of pressure contacted rollers used for giving longitudinal alignment. This arrangement ensures stable lateral alignment. Further, longitudinal alignment and lateral alignment can be performed at almost the same position of sheets, and there is no need to change the sheet position to perform alignment. Thus, the sheet conveyance efficiency is not lowered. Further, there is no need to release pressure from a pair of pressure contacted rollers at the time of lateral alignment. Thus, there is no need a pressure releasing mechanism, with the result that the structure is simply.

What is claimed is:

1. A sheet alignment apparatus, comprising:

a sheet storage section configured to store one or more sheets;

a sheet push-up section configured to push up a trailing edge, in a sheet conveyance direction, of a sheet stored in the sheet storage section to convey the sheet in the sheet conveyance direction;

a sheet discharge section which is provided in a downstream of the sheet storage section in the sheet conveyance direction, is made up of a pair of rollers capable of rotating in forward and reverse directions, and is configured to align the sheet being conveyed by the sheet pushing-up section between the sheet discharge section and the sheet push-up section and then discharge the sheet from the sheet storage section by a forward rotation of the pair of rollers by holding the sheet in a nip portion formed by the pair of rollers;

a sheet width direction alignment section which is provided between the sheet storage section and the sheet discharge section and is configured to align the sheet in a sheet width direction, which is perpendicular to the sheet conveyance direction, after the sheet is stored in the sheet storage section and before the sheet is discharged in the sheet conveyance direction by the pair of rollers; and a control section configured to control operations of the sheet push-up section, the sheet discharge section, and the sheet width direction alignment section such that when a leading edge, in the sheet conveyance direction, of the sheet being pushed up by the sheet push-up section has reached the sheet discharge section, the sheet is aligned in the sheet conveyance direction between the sheet discharge section and the sheet push-up section, and before the sheet is aligned in the sheet width direction by the sheet width direction alignment section, the pair of rollers reversely rotates so as to separate the leading edge of the sheet from the nip portion.

2. The sheet alignment apparatus of claim 1, wherein the controller controls such that the alignment in the sheet conveyance direction by the sheet discharge section and the sheet push-up section and the alignment in the sheet width direction by the sheet width direction alignment section are simultaneously performed.

3. The sheet alignment apparatus of claim 1, wherein the pair of rollers are constituted by an elastic roller and a hard roller having a lower friction coefficient than the elastic roller, and the sheet alignment apparatus comprises a projection member which is provided on a sheet discharging route between the sheet storage section and the sheet discharge section and in a vicinity of the sheet discharge section, and is configured to guide the sheet in a direction in which the leading edge of the sheet conveyed by the sheet push-up section is directed to the hard roller.

4. An image forming system, comprising:

an image forming apparatus configured to form an image on a sheet;

a sheet alignment apparatus which is provided on a downstream side, in a sheet conveyance direction, of the image forming apparatus and is configured to receive and align sheets on which images are formed by the image forming apparatus: the sheet alignment apparatus including:

a sheet storage section configured to store one or more of the sheets;

a sheet push-up section configured to push up a trailing edge, in a sheet conveyance direction, of a sheet stored in the sheet storage section to convey the sheet in the sheet conveyance direction;

a sheet discharge section which is provided in a downstream of the sheet storage section in the sheet conveyance direction, is made up of a pair of rollers capable of rotating in forward and reverse directions, and is configured to align the sheet being conveyed by the sheet pushing-up section between the sheet discharge section and the sheet push-up section and then discharge the sheet from the sheet storage section by a forward rotation of the pair of rollers by holding the sheet in a nip portion formed by the pair of rollers;

a sheet width direction alignment section which is provided between the sheet storage section and the sheet discharge section and is configured to align the sheet in a sheet width direction, which is perpendicular to the sheet conveyance direction, after the sheet is stored in the sheet storage section and before the sheet is discharged in the sheet conveyance direction by the pair of rollers; and a control section configured to control operations of the sheet push-up section, the sheet discharge section, and the sheet width direction alignment section such that when a leading edge, in the sheet conveyance direction, of the sheet being pushed up by the sheet push-up section has reached the sheet discharge section, the sheet is aligned in the sheet conveyance direction between the sheet discharge section and the sheet push-up section, and before the sheet is aligned in the sheet width direction by the sheet width direction alignment section, the pair of rollers reversely rotates so as to separate the leading edge of the sheet from the nip portion; and a post-processing apparatus which is provided on a downstream side of the sheet alignment apparatus and is configured to perform a post-process on the sheet discharged from the sheet alignment apparatus.

5. The image forming system of claim 4, wherein the controller controls such that the alignment in the sheet conveyance direction by the sheet discharge section and the sheet push-up section and the alignment in the sheet width direction by the sheet width direction alignment section are simultaneously performed.

6. The image forming system of claim 4, wherein the pair of rollers are constituted by an elastic roller and a hard roller having a lower friction coefficient than the elastic roller, and the sheet alignment apparatus comprises a projection member which is provided on a sheet discharging route between the sheet storage section and the sheet discharge section and in a vicinity of the sheet discharge section, and is configured to guide the sheet in a direction in which the leading edge of the sheet conveyed by the sheet push-up section is directed to the hard roller.

* * * * *